US009765422B2

(12) United States Patent
Lapierre et al.

(10) Patent No.: US 9,765,422 B2
(45) Date of Patent: Sep. 19, 2017

(54) METHOD FOR LOW-PRESSURE CARBONITRIDING HAVING AN EXTENDED TEMPERATURE RANGE IN AN INITIAL NITRIDATION PHASE

(71) Applicant: ECM Technologies, Grenoble (FR)

(72) Inventors: Philippe Lapierre, Valentigney (FR); Jerome Lardinois, Courcelles les Montbeliard (FR); Yves Giraud, Jarrie (FR); Alfred Rallo, Crolles (FR)

(73) Assignee: ECM Technologies, Grenoble (FR)

( * ) Notice: Subject to any disclaimer, the term of this patent is extended or adjusted under 35 U.S.C. 154(b) by 564 days.

(21) Appl. No.: 14/354,418

(22) PCT Filed: Oct. 8, 2012

(86) PCT No.: PCT/EP2012/069888

§ 371 (c)(1),
(2) Date: Apr. 25, 2014

(87) PCT Pub. No.: WO2013/064335

PCT Pub. Date: May 10, 2013

(65) Prior Publication Data

US 2014/0238549 A1 Aug. 28, 2014
US 2017/0241008 A9 Aug. 24, 2017

(30) Foreign Application Priority Data

Oct. 31, 2011 (FR) ..... 11 59875

(51) Int. Cl.

| | |
|---|---|
| ***C23C 8/32*** | (2006.01) |
| ***C23C 8/02*** | (2006.01) |
| ***C23C 8/34*** | (2006.01) |
| ***C23C 8/80*** | (2006.01) |

(52) U.S. Cl.
CPC ..... *C23C 8/32* (2013.01); *C23C 8/02* (2013.01); *C23C 8/34* (2013.01); *C23C 8/80* (2013.01)

(58) Field of Classification Search
CPC ..... C23C 8/30; C23C 8/32
See application file for complete search history.

(56) References Cited

U.S. PATENT DOCUMENTS

| | | | | |
|---|---|---|---|---|
| 5,273,585 | A | 12/1993 | Shoga | |
| 8,303,731 | B2 * | 11/2012 | Berlier | C23C 8/34 148/218 |
| 8,784,575 | B2 | 7/2014 | Berlier et al. | |
| 2004/0250921 | A1 * | 12/2004 | Yamaguchi | C23C 8/30 148/218 |

FOREIGN PATENT DOCUMENTS

| | | | |
|---|---|---|---|
| DE | 102010028165 | A1 | 10/2011 |
| EP | 1454998 | A1 | 9/2004 |
| EP | 1885904 | B1 | 12/2009 |
| FR | 2777911 | A1 | 10/1999 |

OTHER PUBLICATIONS

Search report issued in PCT/EP2012/069888 on Jan. 10, 2013.
von Stark, A. et al., Handbook of Thermoprocessing Technologies: Fundamentals, Processes, Components, Safety, Vulkan-Verlag GmbH, 2005, p. 509.
Search report issued in International Application No. PCT/EP2012/069889 dated Jan. 14, 2013.
Search Report issued in International Application No. PCT/EP2012/069890 dated Jan. 15, 2013.

* cited by examiner

*Primary Examiner* — Jessee Roe
(74) *Attorney, Agent, or Firm* — Moreno IP Law LLC

(57) ABSTRACT

A method for the low-pressure carbonitriding of steel parts, in particular parts used in the manufacture of automobiles comprises a heating step that includes a simple heating phase (M) followed by an initial nitridation phase (Ni) from a temperature between 700° C. to 750° C. to a temperature between 860° C. and 1000° C. and carried out using a reduced temperature gradient relative to the simple heating phase. Additionally, alternate cementing (C1-Cn) and nitridation (N1-Nn) steps are performed at constant temperature, wherein the final nitridation step is accompanied with a decrease in temperature immediately before quenching (T).

10 Claims, 3 Drawing Sheets

METHOD FOR LOW-PRESSURE CARBONITRIDING HAVING AN EXTENDED TEMPERATURE RANGE IN AN INITIAL NITRIDATION PHASE

The present invention claims priority of French application 1159875 filed on Oct. 31, 2011 having its content (text, drawings, and claims) incorporated herein by reference.

The present invention relates to a method of low-pressure carbonitriding of steel parts, particularly, although not exclusively, parts used in the manufacturing of automobile vehicles. In particular, the invention also applies to parts used in the manufacturing of agricultural machines, machine tools, or parts in the aeronautical field.

BACKGROUND OF THE INVENTION

A method of low-pressure carbonitriding of steel parts comprises alternate steps of cementation and nitriding at constant temperature, preceded by a heating step and by a temperature equalization step, and followed by a quenching step, is known from document EP 1885904. As a variation, it is provided to inject a nitriding gas during the heating step and/or during the temperature equalization step, from a 800° C. temperature.

OBJECT OF THE INVENTION

The present invention aims at improving the method of the previously-mentioned document, that is, improving the quality of the obtained parts, preferably with a decrease of the treatment time.

BRIEF DESCRIPTION OF THE INVENTION

To achieve this aim, the present invention provides a method of low-pressure carbonitriding of steel parts, particular part used in the manufacturing of automobile vehicles, comprising alternated steps of cementation and nitriding at constant temperature, preceded by a heating step comprising a continuously increasing temperature phase followed by an initial nitriding phase during which the heating is carried on, and followed by a quenching step, wherein the initial nitriding phase is carried out from a temperature in the range from 700° C. to 750° C. and up to a temperature in the range from 860° C. to 1,000° C.

Thus, without increasing the duration of the heating step, the nitrogen enrichment which is performed in conditions promoting a good nitriding is increased, whereby it is possible to shorten or to suppress one of the subsequent nitriding steps and to thus decrease the total treatment time.

According to an advantageous version of the invention, the initial nitriding phase is immediately followed by a first cementation step. Thus, the total suppression of the temperature equalization phase enables to lengthen the initial nitriding phase in a temperature range optimal for nitriding.

According to another advantageous aspect of the invention, during the initial nitriding step, the heating is carried out with a decreased temperature gradient as compared with the continuously increasing temperature phase. Thus, the treatment time in a temperature range optimal for nitriding is further increased.

According to still another advantageous aspect of the invention, the method comprises a final nitriding step accompanied by a cooling immediately before the quenching. Thus, the final nitriding step is also carried out in an optimal temperature range, so that the quality of the treatment is improved.

BRIEF DESCRIPTION OF THE DRAWINGS

The foregoing and other objects, features, and advantages will appear on reading of the following description of different specific non-limiting embodiments of the low-pressure carbonitriding method according to the invention, in relation with the 3 appended drawings which are simplified diagrams illustrating the different steps of the method according to the invention according to different embodiments.

DETAILED DESCRIPTION OF THE INVENTION

Figure 1:
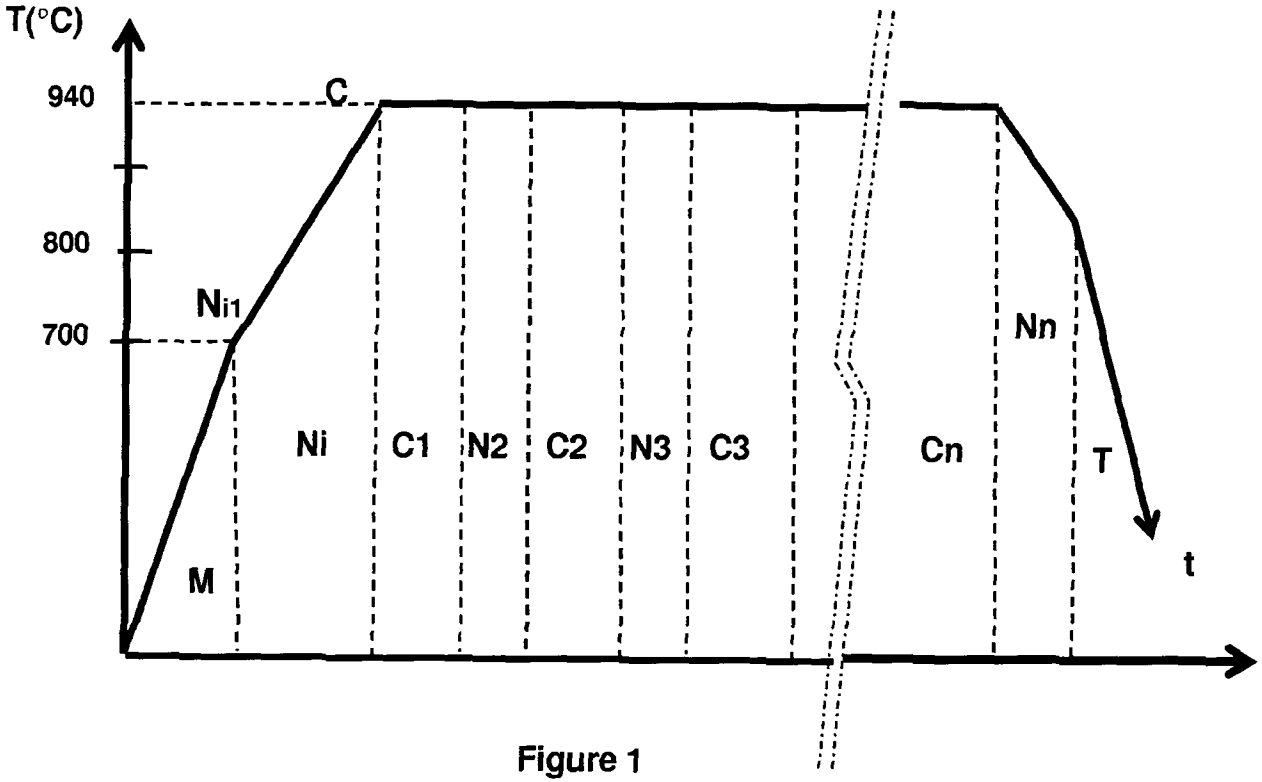

Referring to FIG.1, the method according to the invention comprises a first heating step comprising a first continuously increasing temperature phase M, illustrated by a continuous straight line, from the ambient temperature to a point at a 700° C. temperature, noted Ni1 in the drawing. According to the composition of the steel to be treated, the continuously increasing temperature phase may be carried out until a temperature in the range from 700° C. to 750°C. is reached, and has a duration in the range from 10 min to 90 min, that is, the continuously increasing temperature phase is carried out with a temperature gradient in the range from 8° C./min to 75° C./min.

The method then comprises an initial nitriding phase Ni during which the heating is continued up to a 940° C. temperature in the illustrated example. In practice, the 940° C. temperature corresponds to a compromise between a 860° C. temperature, which enables to achieve a treatment of better quality and a 1,000° C. temperature, which enables to perform a faster treatment.

In the embodiment of FIG.1, corresponding to a first embodiment of the initial nitriding phase, the heating carries on regularly but with a temperature gradient in the range from 3.5° C./min and 16° C./min smaller than the temperature gradient during the continuously increasing temperature phase. The duration of the initial nitriding phase is in the range from 15 min to 45 min, according to the quantity of nitrogen which is desired to be fixed in this initial step and to the composition of the steel to be treated.

As known per se, the initial nitriding phase comprises phases of injection of a nitriding gas such as ammonia alternating with diffusion phases.

Figure 2:
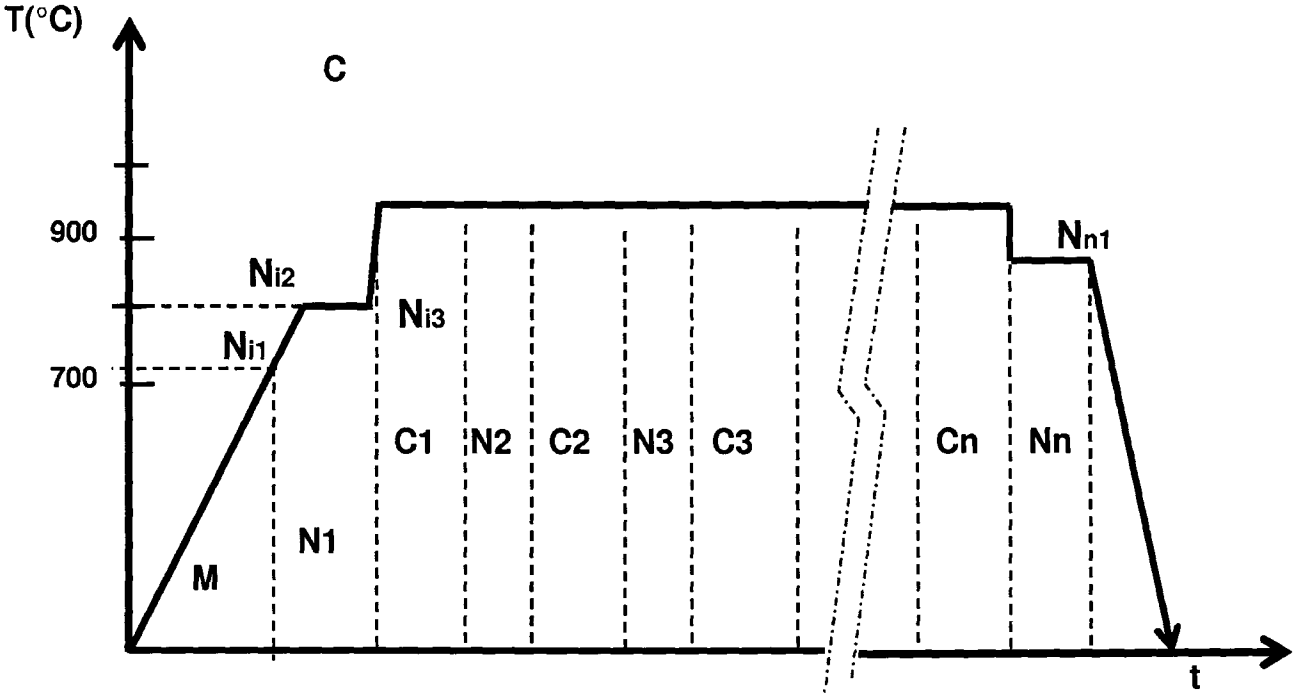

According to a second embodiment of the initial nitriding phase, illustrated in FIG. 2, the heating carries on with the same temperature gradient as during the continuously increasing temperature phase up to a point at a temperature in the range from 750° C. to 850° C., here 800° C., noted Ni2 in FIG. 2. The temperature is then maintained at a stage until a time noted Ni3 in FIG. 2, from which a strong heating is achieved to reach the cementation temperature. The stage temperature is selected in a way known per se to perform the initial nitriding phase in optimal conditions given the composition of the parts to be treated. It should be noted, on this regard, that given the stage, the final heating may be performed very rapidly, for example from 80° C./min to 100° C./min without submitting the parts to inacceptable stress.

Figure 3:
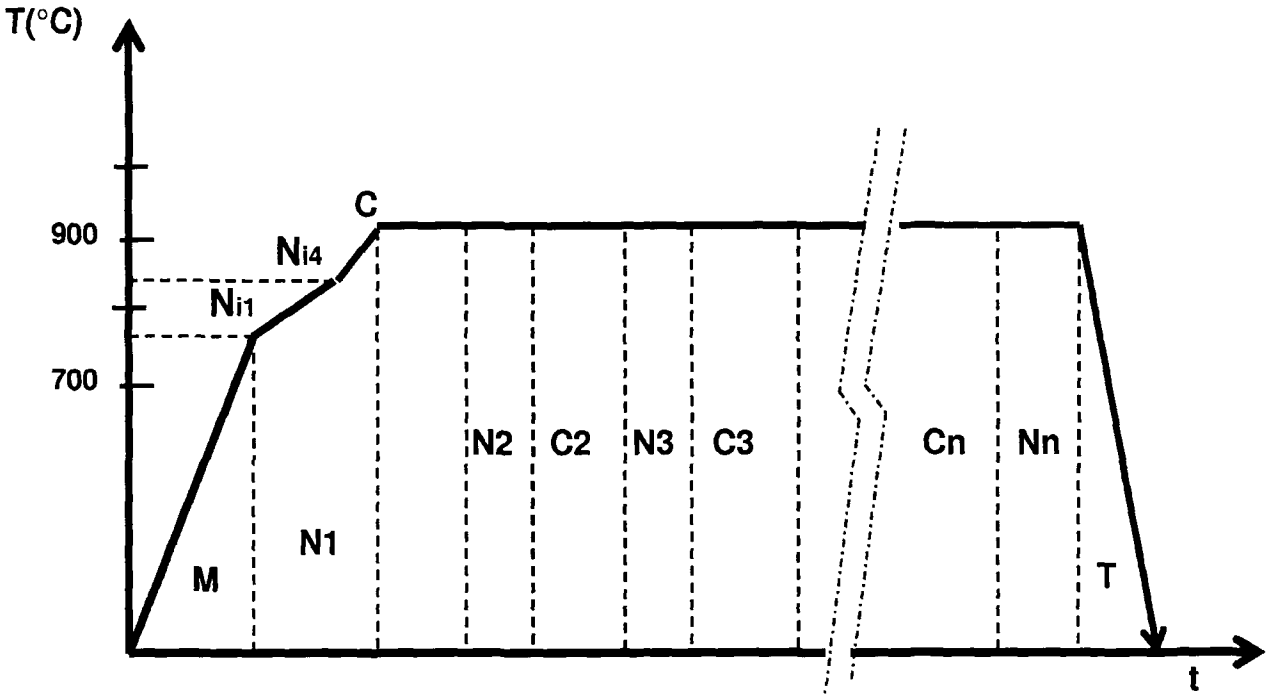

According to a third embodiment of the initial nitriding phase, illustrated by means of FIG. 3, the heating carries on from point Ni1 with a lower temperature gradient than in the first embodiment, preferably in a range from 2° C./min to 8° C./min, until a time noted Ni4, here corresponding to a 850° C. temperature, from which a strong heating is achieved to reach the cementation temperature, according to a gradient similar to that of the second embodiment.

Whatever the embodiment used for the initial nitriding phase, the method then comprises n cementation phases alternating with nitriding phases. As known per se, the cementation and nitriding steps comprise phase of injection of a treatment gas alternating with diffusion phases, not shown in the drawings. In the drawing, the diagram has been interrupted between nitriding step N1 and last cementation step Cn. At the end of this last cementation step Cn, the method comprises a final nitriding step Nn accompanied by a cooling immediately before quenching T.

According to a first embodiment of last nitriding step Nn, illustrated by a short-dashed line in the drawing, the cooling is achieved continuously down to a temperature in the optimal temperature range for the nitriding while remaining sufficiently high to allow an efficient quenching. In the illustrated example, the final temperature before quenching is 840° C. In practice, satisfactory results are obtained for a final temperature before quenching in the range from 900° C. to 800° C. It has been observed that such a limited temperature decrease decreases the stress on parts during the quenching.

The final nitriding step has a duration preferably between 15 min and 60 min, which corresponds to a temperature gradient in the range from 10° C./min to 1° C./min. In the same way as for the initial nitriding phase, the final nitriding step preferably comprises phases of injection of a nitriding gas alternating with diffusion phases.

According to a second embodiment of last nitriding step Nn, illustrated in FIG. 2 by a long-dashed line in the drawing, the cooling is first strong, with as large a gradient as possible without generating undue stress in the steel down to the optimal nitriding temperature for the steel being treated, noted Nn1 in the drawing, here 840° C., after which the temperature is maintained at a stage until the beginning of the quenching.

In practice, the method according to the invention may be implemented by combining any of the embodiments of the initial nitriding phase with any of the embodiments of the final nitriding phase, or even ending the treatment cycle conventionally, that is, with a quenching performed directly from the cementation temperature.

It should be noted that due to the increased efficiency of the nitriding phases according to the invention, it is possible to replace at least one nitriding step comprised between two cementation steps with a simple diffusion step. Such a step is shorter than a nitriding step so that the total treatment time is shortened.

Of course, the invention is not limited to the described embodiment and alternative embodiments may be applied thereto without departing from the framework of the invention such as defined in the claims. In particular, the initial heating may be carried out according to a constant gradient, as illustrated by a dotted line in the drawing. In this case, it should however be noted that the nitriding phase has a shortened duration, as illustrated by a stripe-dot line in the drawing.

Due to the small temperature gradient during the initial nitriding phase, it has been experienced that the temperature of the parts to be treated has time to equalize so that it is possible to suppress the equalizing step provided in the previously-mentioned document. If necessary, for example, due to a specific configuration of the parts to be treated, a short temperature equalization step may however be provided between the initial nitriding phase and the first cementation step.

The invention claimed is:

1. A low-pressure carbonitriding method of steel parts comprising alternating cementation and nitriding steps, preceded by a step of increasing temperature comprising a continuously increasing temperature phase followed by an initial nitriding phase during which the increase of temperature is continued, and followed by a quenching step, wherein the initial nitriding phase is carried out from a first temperature in the range from 700° C. to 750° C. increasing up to a second temperature in the range from 860° C. to 1,000° C.

2. The low-pressure carbonitriding method of claim 1, wherein the initial nitriding phase is immediately followed by a first cementation step.

3. The low-pressure carbonitriding method of claim 1, wherein during the initial nitriding phase, the increase of temperature is carried out with a decreased temperature gradient as compared with the continuously increasing temperature phase.

4. The low-pressure carbonitriding method of claim 3, wherein during the initial nitriding phase, the increase of temperature is carried out with a temperature gradient within a range of temperature gradients from 3.5° C./min to 16° C./min.

5. The low-pressure carbonitriding method of claim 3, wherein the continuously increasing temperature phase is carried out with a temperature gradient within a range of temperature gradients from 8° C./min to 70° C./min.

6. The low-pressure carbonitriding method of claim 3, wherein the initial nitriding phase comprises a temperature plateau.

7. The low-pressure carbonitriding method of claim 1, wherein it comprises a final nitriding step accompanied by a cooling immediately before the quenching.

8. The low-pressure carbonitriding method of claim 7, wherein the cooling is carried out down to a temperature between 900° C. and 800° C.

9. The low-pressure carbonitriding method of claim 7, wherein the cooling is carried out with a temperature gradient within a range of temperature gradients from 10° C./min to 1° C./min.

10. The low-pressure carbonitriding method of claim 7, wherein the final nitriding step comprises a temperature plateau.

* * * * *